United States Patent [19]

Harvey

[11] Patent Number: 4,902,939

[45] Date of Patent: Feb. 20, 1990

[54] DISPLAY CIRCUIT

[75] Inventor: Leslie C. Harvey, Shailer Park, Australia

[73] Assignee: Mosaic Rentals Pty., Ltd., Enoggera, Queensland, Australia

[21] Appl. No.: 177,855

[22] Filed: Mar. 25, 1988

Related U.S. Application Data

[63] Continuation of Ser. No. 816,247, Jan. 6, 1986, abandoned, which is a continuation-in-part of Ser. No. 696,032, Jan. 29, 1985, abandoned.

[30] Foreign Application Priority Data

Feb. 21, 1985 [AU] Australia ..... 39.052/85

[51] Int. Cl.[4] ..... H05B 41/00

[52] U.S. Cl. ..... 315/316; 315/325; 315/DIG. 5

[58] Field of Search ..... 315/294, 297, 312, 315, 315/316, 317, 324, 325, DIG. 4, DIG. 5

[56] References Cited

U.S. PATENT DOCUMENTS

| | | | |
|---|---|---|---|
| 3,935,502 | 1/1976 | Herzog | 315/DIG. 4 |
| 4,464,606 | 8/1984 | Kane | 315/307 |
| 4,559,480 | 12/1985 | Nobs | 315/324 |

*Primary Examiner*—Benedict V. Safourek
*Assistant Examiner*—T. Salindong
*Attorney, Agent, or Firm*—Bauer & Schaffer

[57] ABSTRACT

A discharge tube opening circuit for varying tube intensity at regular intervals without flicker between an illuminated and an unilluminated state. Combinations of tubes controlled by respective circuits give rise to novel display arrangements through choice of tube colors and particular sequences of variation of luminous intensity.

14 Claims, 2 Drawing Sheets

DISPLAY CIRCUIT

This is a continuation of Ser. No.: 816,247 Filed: Jan. 6, 1986, now abandoned which application is a continuation-in-part application of U.S. application Ser. No. 696032 filed 29th Jan. 1985, now abandoned.

FIELD OF THE INVENTION

THIS INVENTION relates to a means and a method for operating discharge tubes and to displays utilising discharge tubes operated according to the method.

BACKGROUND OF THE INVENTION

Generally, in order to continuously vary the intensity of a light source in a display environment, an incandescent source is employed to which a variable voltage supply is connected. The use of these devices in displays causes a problem for the display's designer in that considerable amounts of heat generated by the incandescent lamps utilised therein must be taken into account in making the design. The heat generated by incandescent lamps must be dissipated otherwise overheating occurs and lamps burn out. The problems associated with incandescent lamps are largely avoided by adopting light sources such as fluorescent tubes. Fluorescent tubes present problems because of flicker when coming on such as to impair their usefulness in a continuously varying display where the flicker destroys the aesthetics of the display and introduce cost penalties in providing components needed for their ignition and control. It is known to continuously vary the intensity of a fluorescent tube over a range of intensities, but flicker free operation from a switched off condition is another problem. As a result, fluorescent tubes have not found application in displays to the same extent as incandescent sources whose intensity is readily and simply variable, and neon tubes which may be switched on without flicker, but are normally operable in a steadily more intense regime built up from a switched off condition.

SUMMARY OF THE INVENTION

The present invention enables the operation of gas discharge lamps, such as fluorescent and neon tubes, in an operative regime wherein the tubes may be controlled with a continuously varied output intensity to provide useful displays.

An object of the invention is a means whereby the intensity of a discharge tube may be continuously varied. Another object of the invention is a display device which may employ a combination of colored discharge tubes each individually operated by a means for flicker free switching and continuous intensity control whereby a continuous range of color effects may be generated using the combination of discharge tubes. Other objects and advantages of the invention will hereinafter become apparent.

The invention achieves its advantages through provision of a discharge tube circuit arrangement for operation of at least one discharge tube comprising a power supply circuit to fire at least one discharge tube, said power supply circuit including means operable to vary the power supply to the tube in accordance with a control signal, at least one control signal generating circuit for supplying said control signal to said power supply circuit, said control signal generating circuit having an input and circuit means to generate a predetermined control signal in response to a switching signal applied to said input, said predetermined control signal varying progressively to thereby cause the power supply circuit to progressively vary the power supplied to the tube between a low luminance level and a high level, and programming means to provide a predetermined pattern of switching signals to said input.

DESCRIPTION OF THE DRAWINGS

In order that the invention may be more readily understood and put into practical effect, reference will now be made to the accompanying drawings which illustrate a preferred embodiment thereof and wherein.

DETAILED DESCRIPTION

Figure 1:
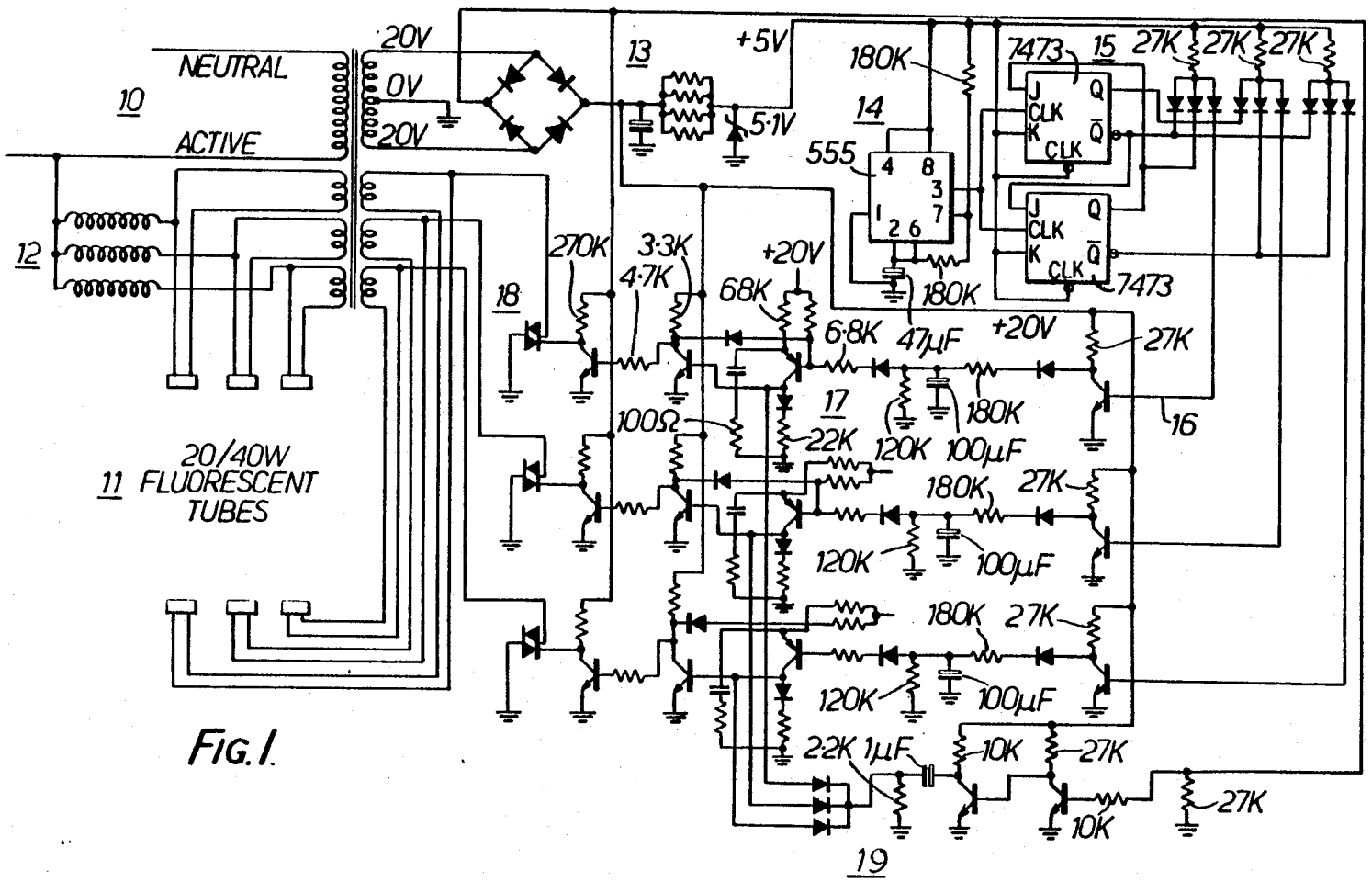
FIG. 1 illustrates a circuit whereby three fluorescent tubes may be driven in accordance with the present invention.

In the embodiment of FIG. 1 power from a supply 10 is fed to discharge tubes, in this case to fluorescent tubes 11 by a power supply circuit employing conventional means such as ballast coils 12 with power to each tube under the control of a gate controlled switch 18 provided one to each tube. The actual on time of switch 18 during each cycle of the supply is set by a program circuit 15 which outputs a signal on line 16 at times set by the connections of the circuit 15. Circuit 15, in this embodiment comprises a pair of master/slave flip-flops such as the 7473 driven by a clocking device formed by a standard timer such as the 555. Control signal generating circuit 17, on receipt of a signal on line 16, using an RC combination, causes switch 18 to progressively input more power to its fluorescent tube to raise it from a non-luminous standby mode to full illumination. After an appropriate period, the reverse of this process is initiated and the tube is returned to a standby, non-luminous mode. Power to the integrated circuits and the switch circuits is supplied by sub circuits 13. Circuit 17 is duplicated for each of the switches 18 and the tubes 11 are fired in a preset sequence with each powering on and off to provide a varying display should tubes of, for example, different colors be employed.

In the figure three fluorescent tubes are controlled by a solid state switching element to produce flicker free operation throughout a range of operating intensities. Control of the switching elements provides a gradual build up of power to the fluorescent tubes to a maximum operating level with the program circuit 15 to determine the on/off sequence of the three fluorescent tubes. Standard integrated timers such as the common 555 may be used in conjunction with master/slave flip-flops such as the 7473 and these can provide the necessary time control to achieve a sequential switching on and off of the fluorescent tubes to provide a particular display sequence.

The power supply circuit 13 provides two outputs. One is filtered by a 220 microfarad capacitor to provide a steady 20 V positive DC supply and the other is an unfiltered 20 V positive DC supply having a 100 Hertz frequency. The filtered supply is fed to a shunt regulator comprising a dropping resistor and a 5.1 V zener diode. This circuit provides the 5 volt DC supply for the integrated circuits used in the circuit.

The 555 timer I.C. of subcircuit 14 provides an astable multivibrator. The frequency of oscillation is determined by the value of the capacitor from pin 2 of the I.C. to ground and the resistors between pin 6&7 and 7&8.

The 7473 dual J K flip flop I.C. of program circuit 15, in addition to the diode logic array, provides sequentially one of three output signals to subcircuit 16. The circuit is clocked by the square wave output of subcircuit 14.

Subcircuit 16 comprises a buffer stage and a resistor, capacitor network. The buffer stage converts the 5 volt logic signal from the subcircuit 15 to an inverted 20 volt signal. This signal is applied to the R C network. The charge, discharge rates are governed by the values of the two resistors and the capacitor. The diode following the network isolates the R C network from influences of the following subcircuit (17).

Subcircuit 19 provides a pulse shaper producing pulses which correspond to the zero cross-over point of the sinusoidal input AC waveform from the mains supply. This pulse is fed to subcircuit 17.

Subcircuit 17 is a pulse stretching or modulating circuit. The incoming voltage from subcircuit 16 varies the pulse width of the signal provided from subcircuit 19. The last transistor in this section is fed pulsed DC collector volts so as to provide a trigger voltage used to switch the triac every half cycle of the AC volts applied to the triac.

Once the voltage of the collector of the transistor rises above 0 volts, the triac of subcircuit 18 switches on and the base signal applied to this transistor is used to switch off the transistor (thus the triac) after the time duration of the pulse determined by the preceeding circuitry.

In the switching subcircuit 18 triacs are switched on for a variable length of time thus providing a path to neutral from the fluorescent tube for the AC power. The variable pulse duration reduces the effective power supplied to the tube.

The ballast coils 12 provides a current limiter once the fluorescent tubes have initially struck.

The filament windings keep the inert gas in the tube ionised so as not to have the tube flash on application of power to the tube.

The circuit of FIG. 1 enables the progressive lighting of a luminiscent panel in front of said tubes with each tube switched to a luminous state from a non-luminous standby condition in which the tube has sufficient power applied to it to maintain it in its fired state, with a gradual build up of intensity to full power, and a gradual drop off thereafter to the non-luminous standby state after preset times at the full power or low power condition.

The circuit of FIG. 1 when employed with a combination of three different colored fluorescent tubes may be used to operate the tubes behind a luminiscent panel carrying a transparency, such as an outdoor scene so as to light the transparency in a manner simulating the night, day light variations which would be observed in real life. Thus night, dawn, day, sunset and dusk may be continuously reproduced in a large optical display carrying an outdoor scene in transparency form. The changes of illumination may be preset to take the scene through the day/night cycle in any particular timed pattern.

The circuit of FIG. 1 might be used with any combination of fluorescent tube colors and display panel to produce a timed sequence of vari-coloured illumination levels at the discretion of the display's designer. A black light tube might also be employed to cause fluorescence of areas in the luminiscent panel located on the display, either on the transparency or a separate transparency added in overlay to that carrying the rest of the displayed material. Using different colored fluorescent tubes behind overlaid transparencies, each carrying differently colored presentations corresponding to the different fluorescent tubes, may allow different ones of the overlays to be separately highlighted to produce further novel display effects.

The display of the invention envisages the timed sequencing of the switching of a fluorescent tube to different power levels in either a stepped sequence of luminous levels or continuous variations of levels. Additional tubes may be combined to give further variations on the range of intensity levels which might be produced and to add in the possibility of varying the color of the display as the tubes are powered in varying sequences. Thus a wide range of hitherto unknown lighting sequences are obtained to provide back lit display panels with, for example, luminiscent surfaces lit from behind with one or more transparencies formed in the luminiscent surface. Additionally, a number of overlaid transparencies may be employed to achieve a desired display layout.

In the circuit of FIG. 1, the discharge tubes are fluorescent tubes. Described below is how the above circuit may be also employed so as to operate neon tubes.

Figure 2:
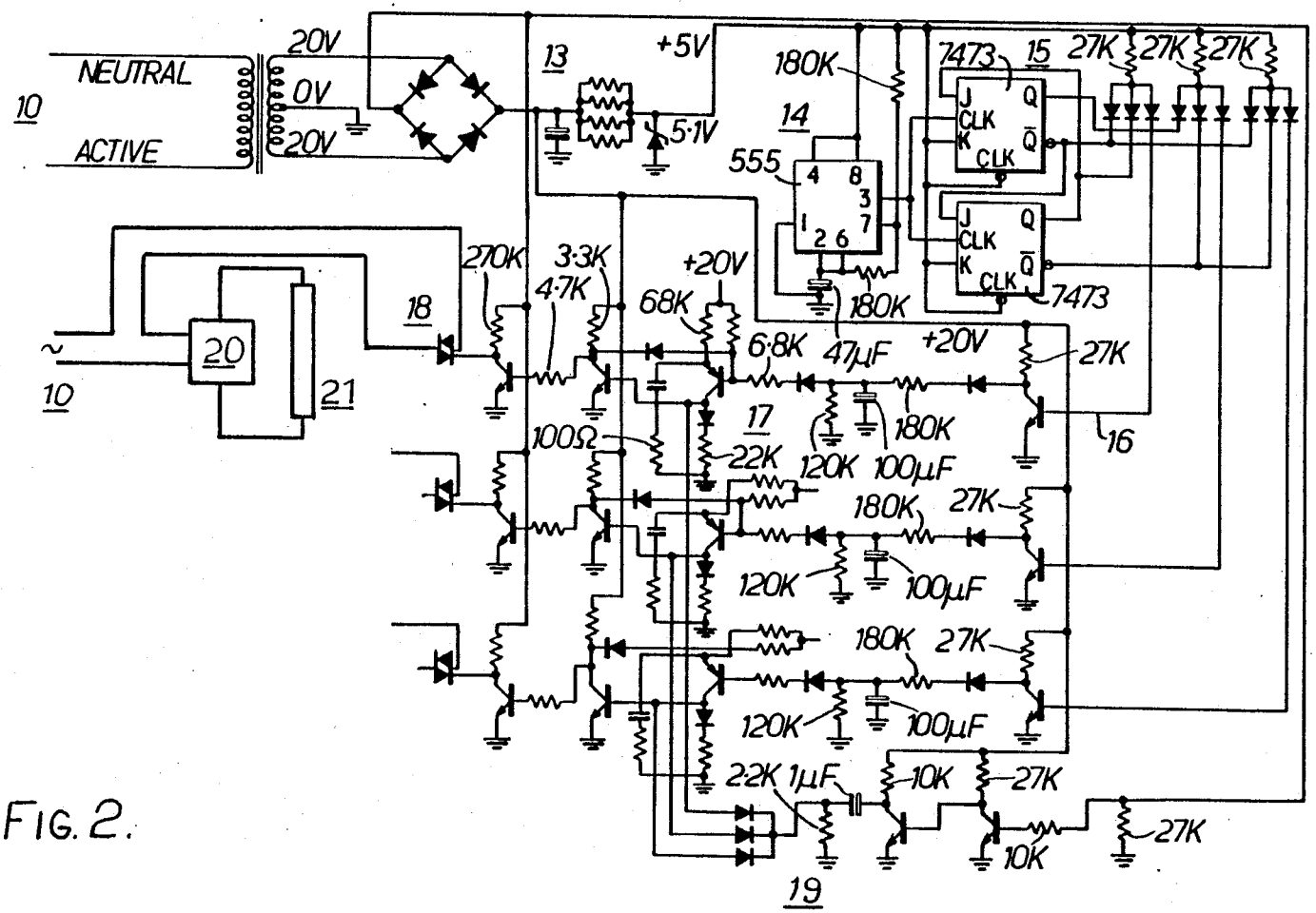
FIG. 2 shows how the circuit of FIG. 1 is adapted to operate neon tubes.

In FIG. 2 the circuit is modified to suit the power requirements of neon tubes. The operation of the circuit is as above set out in respect of fluorescent tubes and like parts are like numbered.

In the embodiment of FIG. 2 power from a supply 10 is fed to discharge tube 21 in this case a neon tube by a power supply circuit employing conventional means such as step up transformer 20 with power to the tube 21 under the control of a gate controlled switch 18 one switch being provided for each tube. The actual on time of switch 18 during each cycle of the supply is set by a pulse generator 19 via a pulse width modulator in control signal generating circuit 17 associated with each switch 18. The signal generating circuit 17 receives a varying signal under control of program circuit 15 which outputs a signal to subcircuit 16 at times set by the connections of the circuit. Program circuit 15 in this embodiment comprises a pair of master/slave flip-flops such as the 7473 driven by a clocking device formed by a standard timer such as the 555. Control signal generating circuit 17, on receipt of a signal from subcircuit 16, using an RC combination, causes triac switch subcircuit 18 to progressively input more or less power to its discharge tube to raise it from a non-luminous state to full illumination or vice versa. Power to the integrated circuits and the switch circuits is supplied by sub circuits 13. The circuits 17, each being duplicated for each of the subcircuit switches 18 for a plurality of tubes only one of which is shown in FIG. 2, fires their tubes in a preset sequence with each powering on and off of the individual circuits 17 to provide a varying display should tubes of, for example, different colours be employed.

As with the embodiment of FIG. 1, the circuit of FIG. 2 enables the progressive lighting of a luminiscent panel in front of said tubes with each tube switched to a luminous state from a non-luminous condition, with a gradual build up of intensity to full power, and a gradual drop off thereafter to the non-luminous state after preset times at the full power or low power condition.

The circuit of FIG. 2 when employed with a combination of three different colored discharge tubes may be used to operate the tubes behind a luminiscent panel carrying a transparency, such as an outdoor scene so as to light the transparency in a manner simulating the night, day light variations which would be observed in real life. Thus, night, dawn, day, sunset and dusk may be continuously reproduced in a large optical display carrying an outdoor scene in transparency form. The changes of illumination may be preset to take the scene through the day/night cycle in any particular timed pattern.

While the above has been given by way of illustrative example, many modifications and variations as would be apparent to persons skilled in the art may be made thereto without departing from the broad scope and ambit of the invention as herein set forth and defined in the following claims.

I claim:

1. A discharge tube control circuit for progressive and either continuous or intermittent variation of the luminance of one or more discharge tubes in accordance with a programmed sequence whereby the luminance of the tubes is progressively changed between high and low luminance output levels so as to progressively and automatically change the illumination of a visible object illuminated by the tubes, said control circuit comprising:

(a) control signal generating means having
  (i) an input for a switching signal,
  (ii) switching means actuated by the switching signal to control an RC network having a predetermined charge/discharge rate proportional to the pattern of switching signals,
  (iii) circuit means generating a control signal, and
  (iv) modulating means driven by the RC network and modulating the control signal in response to the pattern of switching signals and the RC network whereby the control signal is progressively varied;

(b) programming means for the switching signal, said programming means including timer means generating timing pulses of a predetermined frequency giving rise to a predetermined pattern of switching signals; and (c) a power supply circuit for the discharge tubes and including supply means to fire the tubes and to maintain the tubes in a fired state, power supply varying means responsive to the control signal to vary the power supplied to the tubes in accordance with the changes in the control signal as determined by the programming means.

2. A discharge tube circuit according to claim 1 wherein said power supply varying means comprises a gate controlled switching device, said control signal being applied to the gate thereof.

3. A discharge tube circuit according to claim 2 wherein said switching device is a triac in a neutral to earth connection of the tube.

4. A discharge tube circuit according to claim 1 wherein said control signal generating means includes a pulse generator and a pulse width modulator, the pulse width modulator receiving a varying signal derived from said RC network to vary the width of the pulses generated by the pulse generator, the varying width pulses being applied to said power varying means.

5. A discharge tube circuit arrangement according to claim 1 wherein said programming means comprises a timing clock generating clock pulses which drive a pair of flip flops to product a pattern of switching signals having predetermined intervals.

6. A discharge tube circuit arrangement according to claim 5 wherein said switching signals have predetermined durations.

7. A discharge tube circuit arrangement according to claim 1 wherein separate power supply circuites and control signal generating circuits are provided to operate each of a plurality of discharge tubes.

8. A discharge tube circuit arrangement according to claim 7 wherein said programming means provides a predetermined periodic pattern of switching signals to each input of each control signal generating circuit whereby the power supplied to each tube varies independently from each other tube.

9. A discharge tube circuit according to claim 1 wherein the discharge tube is a neon tube.

10. A discharge tube circuit according to claim 9 wherein said control signal generating means includes a pulse generator which supplied a pulse signal to the modulating means, the pulse signal being modulated to control the power supply circuit when a switching signal is present at the input, the pulse signal having a frequency which is a function of a power source frequency.

11. A discharge tube circuit as claimed in claim 1 wherein, in a standby mode, with no switching signals applied to the input of the control signal generating circuit, said tube is maintained in its fired state in a low power standby mode with minimum light output.

12. A discharge tube control circuit for continuously and independently varying the luminance of a number of fluorescent tubes between a high a low luminance level output in accordance with a predetermined programmed sequence, said control circuit comprising:

(a) a power supply circuit to fire the discharge tubes and to maintain the tubes in a fired state;

(b) power supply varying means associated with the power supply circuit to automatically vary the power supplied to the tubes in accordance with a control signal to vary the luminance level output of each of the tubes independently;

(c) control signal generating means for each power supply varying means and having an input for a switching signal an RC network having a predetermined charge/discharge rate proportional to the switching signal pattern circuit means providing a predetermined control signal for the power varying means and modulating means responsive to the RC network to modulate the control signal, said control signal generating means being responsive to the switching signal to progressively vary the control signal; and (d) programming means for said switching signal to provide a predetermined pattern of switching signals to thereby produce a predetermined variation of luminance level output of the discharge tube.

13. A display device comprising a discharge tube circuit as claimed in claim 12 and a visual display means adapted to be illuminated by each fluorescent tube.

14. A visual display comprising a translucent screen containing or embodying a multicolored display, at least three fluorescent tubes of different colors or spectral emissions disposed behind the screen and a discharge tube circuit according to claim 12 having separate power supply circuit, control signal generating means and programming means for each tube to cause the luminance level output of each tube to vary in accordance with the respective programming means so that the screen emits light of varying color and intensity as a result of the combination of the varying luminance of each tube.

* * * * *